United States Patent [19]

Johns

[11] 4,334,228

[45] Jun. 8, 1982

[54] BIFILAR ANTENNA TRAP

[76] Inventor: Robert H. Johns, 3379 Papermill Rd., Huntingdon Valley, Pa. 19006

[21] Appl. No.: 249,440

[22] Filed: Mar. 31, 1981

Related U.S. Application Data

[63] Continuation-in-part of Ser. No. 222,241, Jan. 2, 1981, which is a continuation-in-part of Ser. No. 162,928, Jul. 17, 1980.

[51] Int. Cl.[3] ..... H01Q 1/00

[52] U.S. Cl. ..... 343/722

[58] Field of Search ..... 343/749, 722; 333/175, 333/185

[56] References Cited

U.S. PATENT DOCUMENTS

| | | | |
|---|---|---|---|
| 2,129,514 | 9/1938 | Wertheimer | 343/749 |
| 2,422,458 | 6/1947 | Amy et al. | 343/749 |
| 3,419,869 | 12/1968 | Altmayer | 343/749 |
| 3,560,895 | 2/1971 | Matsumoto | 333/175 |
| 4,255,728 | 3/1981 | Doty | 333/185 |

*Primary Examiner*—Eli Lieberman

[57] ABSTRACT

Antenna traps without a separate capacitor component are disclosed. The traps are tuned by the capacitance between bifilar coils employed as the trap inductor. Simplicity, low cost, and ease of fabrication are the advantages of this trap. Two methods for winding a trap antenna from a continuous wire that becomes both antenna segments and resonant traps are also disclosed.

2 Claims, 17 Drawing Figures

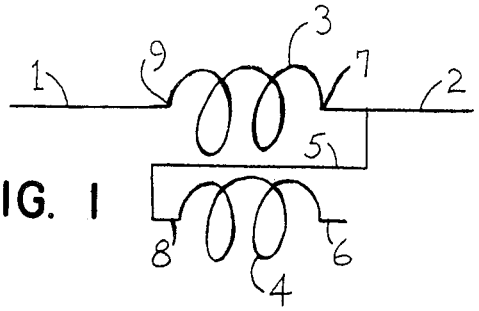
FIG. 1
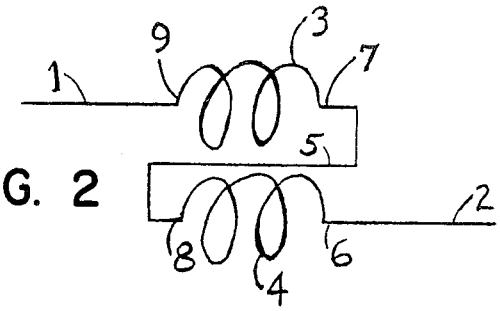
FIG. 2
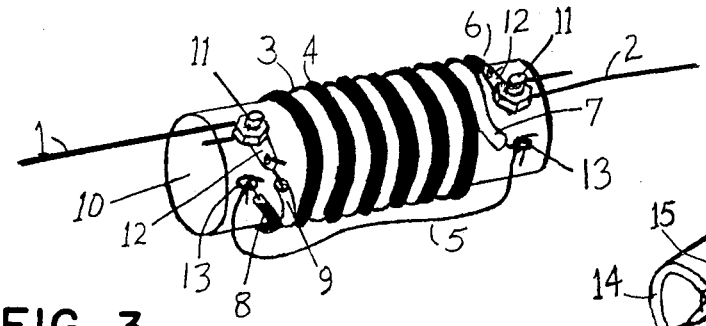
FIG. 3
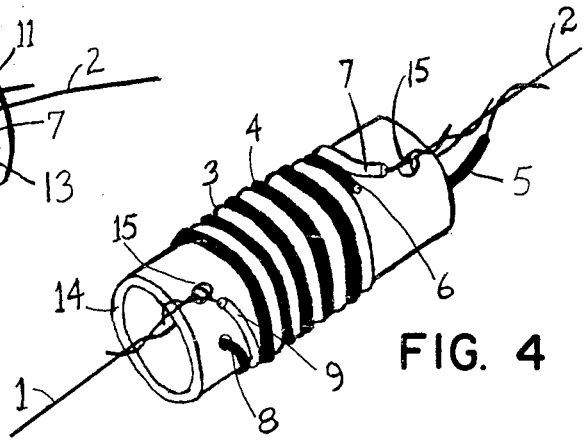
FIG. 4
FIG. 5A
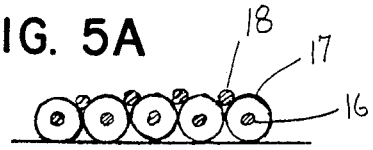
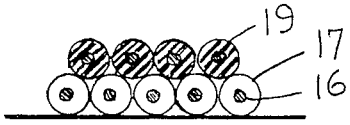
FIG. 5B
FIG. 6A
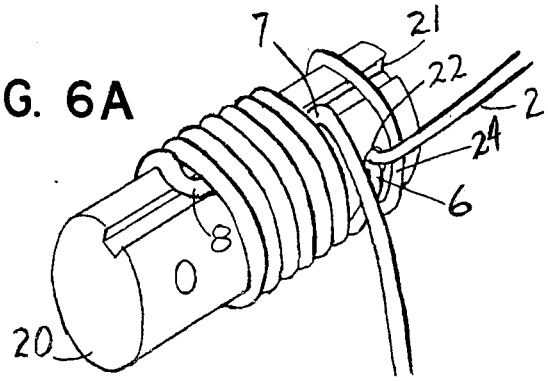
FIG. 7
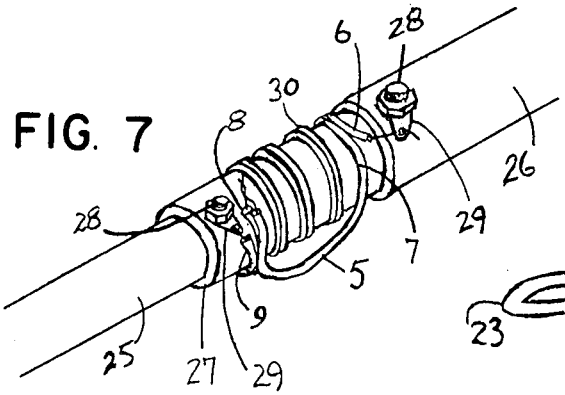
FIG. 6B
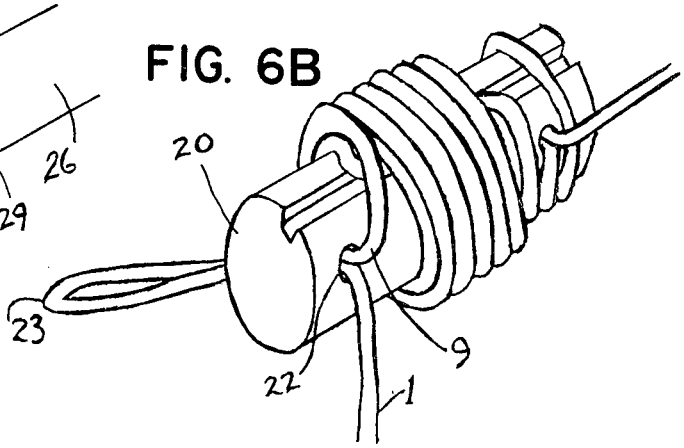

BIFILAR ANTENNA TRAP

This application is a continuation in part of my application Ser. No. 222,241, filed Jan. 2, 1981 which is a continuation-in-part of my application Ser. No. 162,928, filed July 17, 1980.

BACKGROUND OF THE INVENTION

This invention relates to improvements in the art of constructing antenna traps which are used to provide multiband operation on a single antenna. A trap is a parallel resonant circuit inserted in an antenna which offers a high impedance to currents flowing in the antenna at the trap's resonant frequency, separating the inner portion of the antenna between the feedline and the trap from the remainder of the antenna. The inner portion is of a length to be resonant at the trap frequency and is an efficient absorber and radiator of radio waves of that frequency and nearby band of frequencies. Many traps can be incorporated into a single antenna, enabling the antenna to be used on many bands. Traps are well known and used in many types of antennas, such as dipoles, vertical monopoles, parasitic beams, and the like.

PRIOR ART

Typical trap constructions include both an inductor and a capacitor to establish a parallel resonant circuit, though in some antennas made from tubing the capacitor is incorporated into the structure as a coaxial rod or tube inside and insulated from the antenna tubing. In this invention, the trap capacitor is eliminated as a separate component and the capacitance between series-connected bifilar coil windings is employed to resonate the coil's inductance to the desired trap frequency. Carlson, in U.S. Pat. No. 3,465,267 has employed the interwinding capacitance between bifilar coils to produce a parallel resonant circuit in his generalized circuit component, and Matsumoto, in U.S. Pat. No. 3,560,895 has used the capacitance between bifilar coils to tune an interstage transformer to a resonant frequency. Neither of these prior art devices is suitable for antenna trap use because of mechanical support and electrical connector deficiencies. In my application Ser. No. 06/162,928 an antenna trap is disclosed that utilises the capacitance between inner and outer conductors of coaxial cable as the trap capacitor, thus eliminating a separate component in a trap in which the outer coaxial cable braid is used as the trap inductor. This invention discloses another novel structure that does not need a separate capacitor in an antenna trap, that is realized with ordinary insulated wire.

SUMMARY OF THE INVENTION

In this invention, a parallel resonant trap circuit is constructed from insulated wire bifilar coils, without employing a separate capacitor. The capacitance between the windings is electrically in parallel with the coil incuctance to tune the trap. As more turns of wire are wound into the bifilar coils, both the inductance and capacitance are increased, lowering the trap frequency and providing a convenient way of preparing traps of different resonant frequency. The traps are of very simple construction and low cost. A further provision of this invention are methods whereby these bifilar traps may be included into a trap antenna system made from a continuous wire, without requiring any electrical connections within the traps or between the traps and the antenna segments.

BRIEF DESCRIPTION OF THE DRAWINGS

FIG. 1 is a schematic diagram of one embodiment of the bifilar antenna trap.

FIG. 2 is a schematic diagram of an alternate embodiment of a bifilar antenna trap.

FIG. 3 is a perspective view of one embodiment of this invention that utilizes the coil connection illustrated in FIG. 2.

FIG. 4 is a perspective view of an alternate embodiment of this invention that utilizes the coil connection illustrated in FIG. 1.

FIG. 5 shows two alternate coil winding configurations in cross-section.

FIG. 6 shows two perspective views of the winding of a bifilar trap so that the coil wire is continuous with the antenna wire on either side of the trap.

FIG. 7 shows a perspective view of a bifilar trap for use in antennas made from metal tubing.

DETAILED DESCRIPTION OF THE INVENTION

Figure 8A:
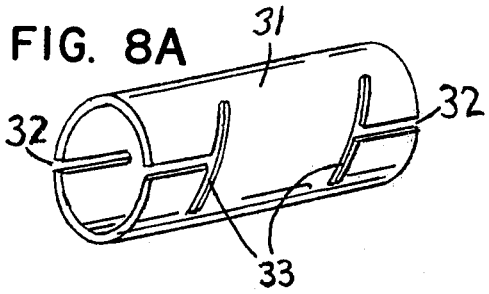
FIG. 8 shows eight perspective views of the winding of a bifilar trap onto a trap insulator made from hollow tubing with slots in it.

In FIG. 1, bifilar coils 3 and 4 are included between antenna segments 1 and 2. A cross-connection 5 joins opposite ends of the bifilar coils 7 and 8, joining the two coils in series so that their inductances reinforce or aid one another, rather than oppose one another. This connection makes one large coil out of the two smaller coils as to magnetic or inductive effects. The usual distributed capacity between adjacent turns is greatly increased by the bifilar construction, since the turns from different coils that are close to one another, such as the turns 8 and 9 at the left ends, have much greater rf voltage between them than do adjacent turns in a single coil. This capacitance between bifilar coils is in parallel with the combined coil inductance and forms a parallel resonant circuit with the bifilar coils. In this embodiment, antenna segments 1 and 2 are connected to the ends of only one of the bifilar coils, coil 3. The high impedance at resonance still functions to disconnect unwanted antenna segments from the resonant one, even though the antenna is connected across only part of the trap resonant circuit. At lower frequencies the single coil offers less impedance as a loading coil than both bifilar coils would. This is an advantage where wide bandwidth is desired, since large loading inductors restrict the bandwidth of an antenna.

In FIG. 2 a similar pair of bifilar coils is shown, together with the cross-connection 5, as in FIG. 1. The antenna segments 1 and 2 in this configuration are connected to the ends of the overall inductor formed by the two bifilar coils in series. This antenna connection does not affect the trap resonant frequency except to a minor degree, but places the two coils in the antenna as loading coils at lower frequencies. This arrangement is an advantage in applications where the greatest loading or shortening of the physical length of the trap antenna is desired.

It will be appreciated that the ratio of inductance to capacitance within the trap can be controlled by changing the number of turns of wire in the second coil 4 of FIG. 1, since these coils need not have the same number of turns. In addition, the amount of loading inductance

BRIEF DESCRIPTION OF THE DRAWINGS

Figure 8B:
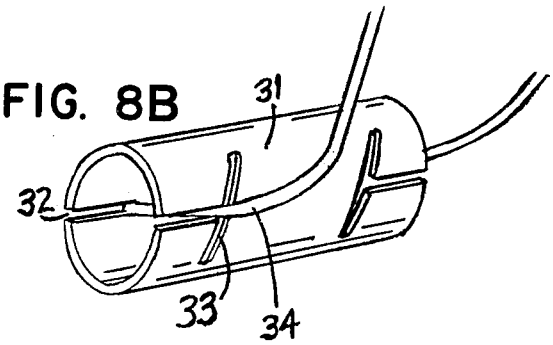
Figure 8C:
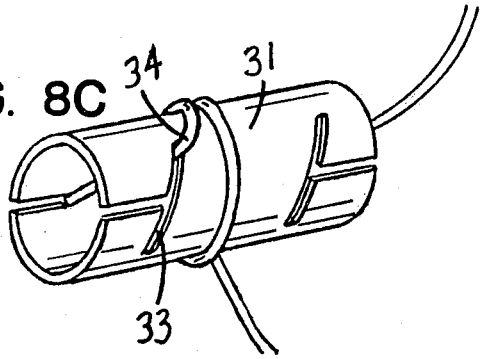
Figure 8D:
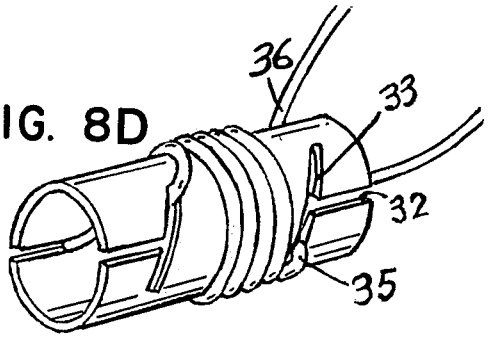
Figure 8E:
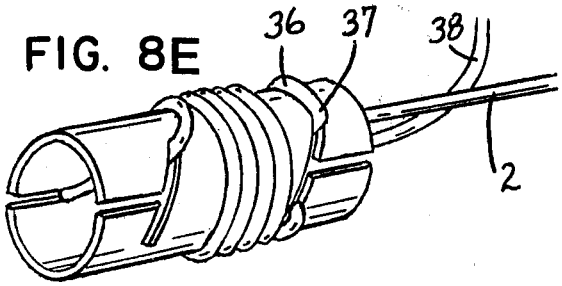
Figure 8F:
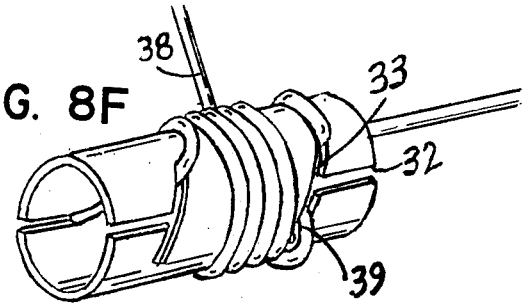
Figure 8G:
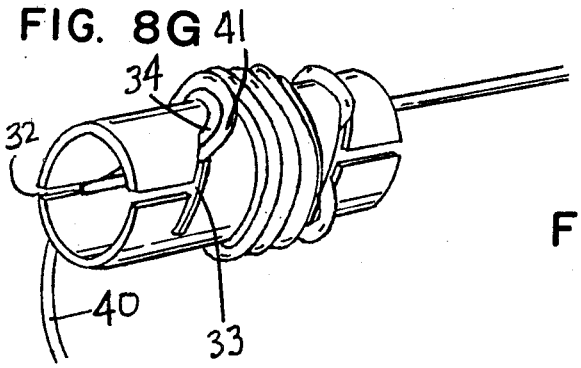
Figure 8H:
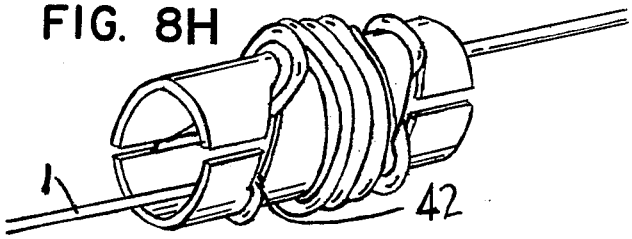

FIG. 1 is a cross sectional view through a conventional printing head illustrating the position of a pair of charge plates made in accordance with the present invention;

FIG. 2 is a plan view of a charge plate made in accordance with the present invention and secured to a base plate with a plurality of lead lines connected thereto for providing the charge to the individual conductive elements;

FIG. 3 is an expanded cross sectional view of a plurality of charge tunnels formed by the adjacent conductive and nonconductive elements laminated in accordance with the present invention;

FIG. 4 is an enlarged cross sectional view along line 4—4 of FIG. 2;

FIG. 5 is a pictorial view of an alternative preferred embodiment illustrating a configuration for the conductive and nonconductive elements to reduce inter element capacitance;

FIG. 6 is a view of a laminated charge plate as illustrated in FIG. 5, showing the overlapping regions of the support areas and the terminus connections associated with the charging elements;

FIG. 7 is an end view outboard of the charge tunnels of the embodiment illustrated in FIG. 6;

FIG. 8 is a cross sectional view similar to FIG. 3, of an alternative embodiment having a conductive coating applied to the nonconductive elements; and FIG. 9 is a cross sectional view similar to FIG. 8, of a further alternative embodiment without charge tunnels.

DETAILED DESCRIPTION OF THE PREFERRED EMBODIMENTS

As was indicated previously, the present invention is designed for use in an ink jet printing device of the type disclosed generally in Taylor et al. U.S. Pat. No. RE. 28,219 and particularly for use in an ink jet printing head as disclosed for example in Houser U.S. Pat. No. 3,701,476, reference to which can be made for an indication of the context in which the embodiments of the present invention may be utilized.

Such a printing head is shown schematically in cross section in FIG. 1 and is composed of a manifold 10 providing a central reservoir 12 in which the printing liquid is contained under pressure and which is ejected through a plurality of orifices 14 which extend in parallel rows in a plane perpendicular to the plane of the figure. The orifices are formed in an orifice plate 16 which is secured to the base of the manifold 10. Immediately beneath the orifice plate 16 are positioned a pair of charge plates 20 and 22 made in accordance with the present invention.

The openings or charge tunnels 24 and 26 formed therein correspond to the positions of the orifices 14 and a plurality of charge tunnels extend in registry with the plurality of orifices along the length of the orifice plate so that each orifice and the streams of droplets 28 which are expelled therefrom are all in registry. The droplets 28 will pass through the respective charge tunnels and either strike the recording medium 30, which can be, for example, a web of paper moving in the direction indicated by the arrow.

A pair of conventional catchers 32 and 34 are interposed between the charge plates 20 and 22 and the recording medium 30 adjacent the trajectories of the droplets. A deflection ribbon 36 is disposed between the parallel rows of droplets 28 coming from orifices 14 and, in a conventional manner, deflects selected ones of the droplets into the catchers so that they will not impact recording medium 30. The charge plates 20 and 22 are used to place the charge on the droplets coming from orifices 14 so that selected droplets upon which a charge is placed will be deflected by the deflection ribbon 36.

Referring more specifically to the details of the construction of the preferred embodiments of charge plates of the present invention, one such contemplated construction is shown in FIGS. 2–4. In this construction the charge plate 20 (charge plate 22 is identical) is composed of a plurality of alternately positioned conductive elements 40 and nonconductive elements 42 sandwiched or laminated together to form an elongated charge plate of generally rectangular cross section as illustrated in FIG. 4. The conductive and nonconductive elements 40 and 42 can be secured together with an appropriate adhesive or by utilization of a frame structure (not shown) if desired.

As seen in FIG. 2, the plurality of conductive and nonconductive elements 40 and 42 after being laminated together are secured to a backing member 44 made of non-conductive material, to provide additional support for the laminated elements. In addition, backing member 44 provides a mounting surface for the plurality of lead wires 46 which extend from each of the conductive elements 40 to a junction block 48 which in turn is connected to the control mechanism, (not shown) for individually charging each of the conductive elements 40. A plurality of junction blocks 48 can be used for a single charge plate in order that all of the leads 46 do not have to terminate in a single junction block.

As illustrated in the embodiments of FIGS. 2–4, however, it is further contemplated that a spacer member 52 be positioned between the end portions of nonconductive elements 42 which extend outboard from the orifice position 14 in order to provide additional support for the nonconductive members and maintain proper spacing therebetween. These spacer elements 52 are of the same thickness as conductive elements 40 and thus maintain the parallel position of the adjacent nonconductive end portions of elements 42.

In addition, it is contemplated that in order to enhance the charging characteristics of each of the charge tunnels 24 a conductive coating 54 may be applied to the side walls of nonconductive elements 42 which form the charge tunnels 24. Also, the spacer element 52 can be formed of the same conductive material as element 40 thus resulting in the complete interior surfaces of each of the charge tunnels 24 being conductive to thus increase the uniformity of a charge placed on droplets passed through the charge tunnels 24. Obviously, if spacer member 52 is made of nonconductive material the inner surfaces should likewise be coated with a conductive coating such as 54 in order to place a conductive surface entirely around the inside of each of the charge tunnels 24. The use of conductive surfaces on the sidewalls of the charge tunnels has the further advantage of reducing "cross talk" between adjacent charging surfaces associated with adjacent orifices, so that droplets coming from adjacent orifices that are not supposed to be charged are not charged by the charge tunnel being actuated.

The lead wires 46 which extend from the junction blocks 48 are connected to their respective conductive members 40 such as by soldering or the like, in order to provide a conductive path from a lead wire to a conductive member. Lead wires 46 may be photo-fabricated on the base member 44 as is done with conventional charge plate fabrication.

Referring now to the embodiment illustrated in FIGS. 5–7, as mentioned above, when the spacing between adjacent orifices 14 is relatively close, the possibility of inter element capacitance being developed during the high frequency switching which occurs during the printing operation is enhanced due to the closeness of the positions of adjacent conductive elements. In order to reduce this possibility, it is contemplated that the conductive portions of adjacent conductive elements can be separated as illustrated.

Referring to FIG. 5 a first conductive element 60 may be configured as shown in order to place the conductive path along the upper region of the cross sectional envelope of the charge plate above the longitudinal axis of symmetry of an adjacent nonconductive element, and extending forward and then downward to present the charge surface 62. The nonconductive element 64 is of rectangular cross section and acts as a backing surface for the conductive element 60. Since, as can be seen from the illustration, the conductive element 60 is relatively thin and provides little supporting surface for the lamination between the nonconductive surfaces on each side thereof, a plurality of briding elements 66 are perferably provided. Bridging elements 66 can be either conductive or nonconductive elements since they do not contact the conductive elements 60. The purpose of these bridging elements is merely to provide support between adjacent nonconductive elements 64 since the ribbon like portion of conductive element 60 is insufficient for that purpose.

A second configuration of conductive element 68 is also illustrated which extends along the lower region of the rectangular cross sectioned envelope of the charge plate below the longitudinal axis of symmetry of this adjacent nonconductive element 64 and then upwards to present the charging face 70. As before, a plurality of bridging elements 66 are provided in order to increase the rigidity of the laminated assembly.

Thus, it can be seen that with these alternately laminated conductive elements 60 and 68 with the inner laminated nonconductive elements 64, the possibility of inter element capacitance is reduced since the conductive elements 60 and 68 are disposed respectively in upper and lower regions of the rectangular cross sectioned envelope of the charge plate so that the distance between the conductive elements is increased. The lead wires 46 are secured to each of the conductive elements 60 and 68 as with the previous embodiment although as can be seen from FIGS. 5 and 6, the positions of adjacent leads are staggered to the corresponding positions of the terminus areas of the conductive elements.

Again, although not illustrated in this embodiment, the charge tunnels formed in the laminated structure illustrated in FIGS. 5–7 may be coated around the entire inner surface thereof with a conductive material in order to provide a charging surface along the entire inner surface of each tunnel. Likewise, a plurality of spacer elements 72 are provided to separate the outer end portions of each of the nonconductive elements 64.

In the above described embodiments the conductive and nonconductive elements have been described as individual elements which are adhesively or otherwise secured together to form the charge plate. However, it is contemplated that a single combined element composed of a nonconductive portion with a conductive material deposited on the surface thereof or vice versa. The deposition of material can be accomplished for example, such as by photo-fabrication techniques. This combined element can be used in place of a nonconductive element and an adjacent conductive element of the types described above. These combined elements are then laminated together as in the above described embodiments to form a charge plate.

Alternatively, as a means of simplifying fabrication, rather than placing a conductive coating on the side walls of a charge tunnel 24 after fabrication as disclosed for example in the embodiment of FIG. 3, the conductive coating 54 can be applied to the entire surface area of both sides of each nonconductive element 42 as illustrated in the embodiment of FIG. 8. It is to be noted that if this fabrication technique is utilized it would not be necessary to make elements 40 conductive since connections could be made to the conductive coatings applied to nonconductive elements 42. In this case, in order to have all surfaces of the charge tunnels 24 conductive it would also be necessary to place a conductive coating on the end surfaces of elements 40 and 52.

The present invention as illustrated in its simplest form in FIG. 9. In this embodiment the charge tunnels 24 have been eliminated so that the charge plate is merely formed of a plurality of laminated conductive and nonconductive elements 40 and 42, secured together by adhesive. This form of the invention is the easiest to manufacture, however, it does not possess some of the advantages discussed above for those embodiments having charge tunnels.

Although the foregoing illustrates the preferred embodiments and methods of construction of the present invention, other variations are possible. All such variations as would be obvious to one skilled in this art are intended to be included within the scope of the invention as defined by the following claims.

What is claimed is:

1. A charge plate for an ink jet printing device having a plurality of spaced orifices defined therein in a common plane for printing liquid discharge, comprising:

a plurality of conductive and nonconductive elements secured together in alternating sequence in a direction perpendicular to said common plane of the orifices to form an elongated charge plate of generally rectangular cross section with said conductive elements separated by said nonconductive elements a sufficient distance that said conductive elements will be in registry one each with a corresponding one of said orifices in said ink jet printing device, an edge portion of each said conductive element forming a charging surface parallel to and adjacent the flow of printing liquid from said orifices;

all of said charging surfaces being recessed between adjacent edge portions of said nonconductive elements and exposing side wall surfaces of said edge portions of said nonconductive elements; and a coating of conductive material on said side wall surfaces and engaging said charging surface.

2. A charge plate as defined in claim 1 including:

a spacer element secured between each said adjacent edge portion of said nonconductive elements outboard of said charging surfaces so as to form a plurality of charging tunnels each defined by said charging surface, adjacent side wall surfaces of said the wire of one coil into the opposite end of the other coil, electrical connections between said antenna radiating portions and said coils, formed by a continuation of the wire of said radiating portions into the ends of said coils that are not a part of said cross-connection, whereby the antenna system made up of traps and radiating portions is formed from a continuous length of wire, a generally cylindrical hollow insulator having longitudinal slots in opposing cylinder walls passing inwardly from each end of said insulator for a portion of the length of the insulator, and having transverse oblique slots generally parallel to one another intersecting the inner ends of one of the longitudinal slots at each end of the insulator, whereby said bifilar coils are secured to said insulator and said antenna wire radiating portions are attached to said insulator.

* * * * *